United States Patent [19]

Obata

[11] Patent Number: 4,718,224

[45] Date of Patent: Jan. 12, 1988

[54] STEEL CORE FOR REINFORCING ELASTOMERIC ARTICLES

[75] Inventor: Yasushi Obata, Shizuoka, Japan

[73] Assignee: Tokyo Rope Manufacturing Co., Ltd., Tokyo, Japan

[21] Appl. No.: 944,465

[22] Filed: Dec. 19, 1986

[30] Foreign Application Priority Data

Dec. 23, 1985 [JP] Japan ..... 60-287958

[51] Int. Cl.[4] ..... D02G 3/12; D07B 1/00; D07B 1/10

[52] U.S. Cl. ..... 57/212; 57/902; 428/371

[58] Field of Search ..... 57/200, 210, 212, 215, 57/217, 258, 9, 902; 152/451; 428/371

[56] References Cited

U.S. PATENT DOCUMENTS

| | | | |
|---|---|---|---|
| 2,605,201 | 7/1952 | Howe | 57/902 X |
| 3,805,508 | 4/1974 | Maderna | 57/902 X |
| 4,544,603 | 10/1985 | Richards | 57/902 X |
| 4,545,190 | 10/1985 | Rye et al. | 57/212 |
| 4,566,261 | 1/1986 | Brandyberry et al. | 57/212 |
| 4,679,387 | 7/1987 | Weidenhaupt et al. | 57/212 |

*Primary Examiner*—Donald Watkins
*Attorney, Agent, or Firm*—Michael J. Striker

[57] ABSTRACT

A reinforcing structure for elastomeric articles, having 2–5 filaments. The filaments are arranged in parallel and have a common plane passing through them all. The wire has a diameter smaller than that of the filaments. The wire wraps the filaments together so that a relative position of the filaments with respect to each other and also bending rigidities in predetermined directions do not vary over a full length of the wrapped filament structure.

12 Claims, 10 Drawing Figures

FIG. 8-A

PRIOR ART

FIG. 8-B

PRIOR ART

FIG. 8-C

PRIOR ART

STEEL CORE FOR REINFORCING ELASTOMERIC ARTICLES

BACKGROUND OF THE INVENTION

This invention relates to steel core serving as reinforcing materials of elastomeric articles of tires, belts or the like.

Steel cores are generally used as reinforcing materials for rubber articles, which include tires of motorcars, monorails or building vehicles, conveyor belts, hoses, etc.

Nowadays, the motorcars' tires, for example, are required to have high performance and flatness, and to be lightened in weight and lowered in cost. For satisfying these requirements, it is necessary that not only the rubber itself as a matrix be of excellent quality, but also the steel core itself to be embedded in the matrix has stable structure.

The steel core is, as known, formed by combining a plurality of very fine steel wires. The existing steel cores are structured with a plurality of filaments twisted together at a certain pitch. Therefore an outer contour in a cross section transverse with an axial line has a rounded shape (FIG. 8-A) or a polygonal shape nearly round (FIG. 8-B or FIG. 8-C).

Due to such a structure, elastic rigidities of the steel cores are equal in X-direction and Y-direction. Accordingly, an elastomeric article embedded with the steel cores, e.g., the belt for tire has an equal elastic rigidity vertically (in thickness) and laterally (in width). So, such a quality of the article does not meet the movement performance of the tire satisfactorily. As well, the belt is repeatedly given the bending stresses during a long period of life of a radical tire. Since the belt is poor in vertical flexibility, it has trouble countering against fatigue-weakening.

With respect to lightening weight of the tire and the belt conveyer, it is effective to decrease the number of the steel cores to be buried in the belt. However, if the number of buried steel cores per unit area of the belt were decreased, the rigidity of the belt would be lowered, as would the resistance to nails, rocks and so on. Therefore, a satisfactory lightening in weight could not be achieved.

With respect to lowered cost, it is, as known, effective to make the thickness of the gauge of a calendar sheet composing the belt thin. But since the conventional steel core has its cross section perpendicular to the axial direction, which has an equal dimension in the vertical and lateral directions, the thickness of the gauge could not be thinned. For accomplishing the object, the filament should be made thin. However, this work involves substantial difficulties and involves the higher cost.

U.S. Pat. No. 4,464,892 (Jacob Kleijwegt) or No. 4,545,190 (Grover W. Rye) propose the steel cores. The former teaches that a strand is formed by twisting together two filaments and helically disposing therearound a single filament of the same thickness as said filament. The latter teaches that helixes formed by a plurality of filaments have a pitch length of 5 to 30 mm, and the pitch length of the helixes of the plurality of filaments is equal to the lay length of the single filament twisted with the plurality of filaments, and said filament is twisted with said strand with a lay length that is equal to said pitch length.

These conventional techniques provide twisting or helical shape to the strands, so that the cross sectional area transverse with the axial line of the core is changed at particular locations. Such requirements as flexibility, faculty of bending fatigue, flatness or weight lightening could not be satisfied.

SUMMARY OF THE INVENTION

This invention has been created to solve the above mentioned problems involved in the prior art.

It is an object of the invention to provide a kind of steel core which may satisfy flexual rigidity, resistance to fatigue-weakening, flatness, weight lightening and cost-reduction.

It is another object of the invention to provide a steel core which does not generate displacements caused by twisting so that workability is preferable.

For accomplishing these objects, the invention goes against the existing conventional teaching that a steel core for reinforcing an elastomeric article should be twisted or shaped helically. The invention provides a steel core having a structure of an untwisted, parallel and single layer. That is, with respect, to the above mentioned steel core, a plurality of filaments and one piece of a wrapping wire smaller in diameter than the former are employed. Said filaments are arranged, untwisted, on the same face, and tied up with said wrapping wire such that the relative positions of all the filaments are not changed, and the elastic rigidity in given directions over the full length of the steel core are uniform throughout.

Said filament is 0.20 to 0.30 mm$\phi$ in diameter, and 2 to 5 pieces thereof are used, and the elastic rigidity is shown, under these conditions, with a rigidity ratio of about 3.0 to 18.5. A resistance to bending fatigue by 3 roller bending fatigue tests resulted for more than 2520 cycles.

BRIEF DESCRIPTION OF THE DRAWINGS

FIG. 8-A, FIG. 8-B and FIG. 8-C show cross sectional views of the conventional steel cores for reinforcing elastomeric articles.

DETAILED DESCRIPTION OF PREFERRED EMBODIMENTS OF THE INVENTION

Figure 1:
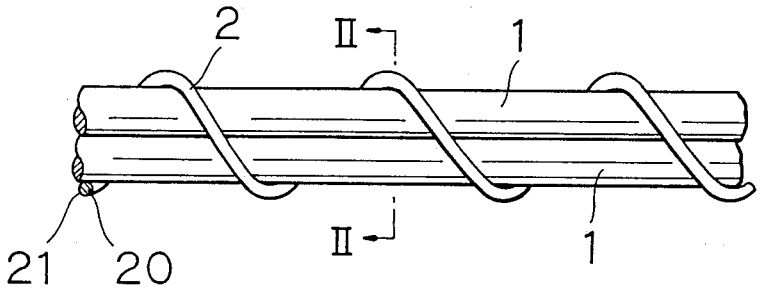
FIG. 1 is an enlarged side view showing one example of a steel core for reinforcing the elastomeric article according to the invention.

The invention will be explained with reference to the attached drawings.

FIGS. 1 to 6 show the steel core according to the invention, designated with a reference numeral 3. The numeral 1 designates a filament which comprises disposing, on very thin steel wire 10 of 0.20 to 0.30 mm$\phi$ in diameter, a metallic plate 11 as brass having good adhesion to a matrix of rubber.

Figure 2:
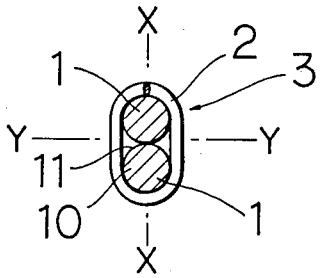
FIG. 2 is a cross sectional view of the above along II—II of FIG. 1.
Figure 3:
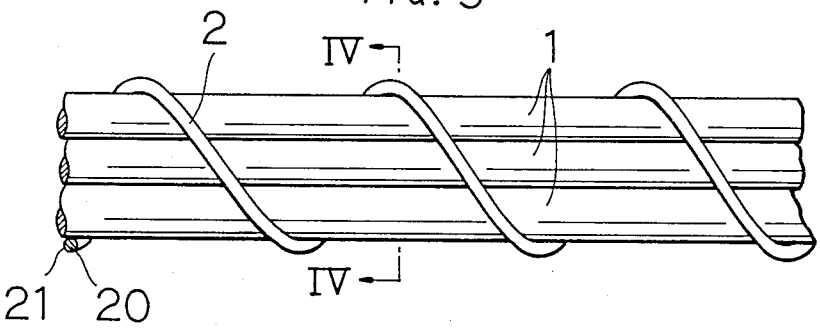
FIG. 3 is an enlarged side view showing another embodiment of the invention.
Figure 4:
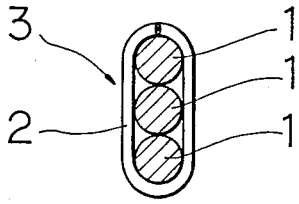
FIG. 4 is a cross sectional view of the above along IV—IV of FIG. 3.
Figure 5:
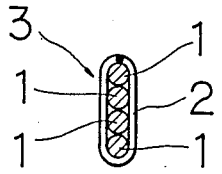
FIGS. 5 and 6 are enlarged views showing further embodiments of the invention.
Figure 6:
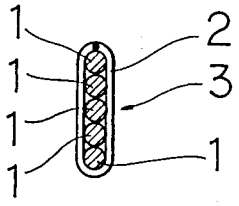

FIGS. 1 and 2 show that two pieces of the filaments 1, 1 are used; FIGS. 3 and 4 show that three pieces of them 1, 1, 1 are used; FIG. 5 shows four pieces 1, 1, 1, 1; and FIG. 6 shows five pieces 1, 1, 1, 1, 1.

The reference numeral 2 designates one piece of a wrapping wire for typing up the filaments 1, 1, . . . The steel wire 20 which is smaller in diameter than the former, comprises a metallic plate 21.

In each of the embodiments, the filaments 1, 1, . . . are not twisted but arranged in parallel each other on the same line (on X line in the drawings), and are firmly tied up by the wrapping wire 2 with a determined pitch, for example, 5.0 to 5.5 mm, such that the relative positions of all the filaments are not varied. In such a manner a single layer (parallel arrangement) is secured.

All of the filaments must not be given twist or torsion when and after they are combined by the wrapping wire 2. In addition, the single layer is essential. An arrangement of 2 layers (plural) is not included in the scope of the invention, though the steel cores are disposed in parallel.

Due to the above mentioned structure, the steel core 3 of the invention has a high rigidity in the X-direction and a low rigidity in the Y-direction traverse to the X face, said directions being uniform at any parts of the core over the full length thereof. It is required that the rigidity ratio (X/Y) of said X-direction and Y-direction should be within about 3.0 to 18.5. If the filaments were more than 6 pieces, the bending fatigue resistance would be preferable, but the difference between X- and Y-directions would be too large. Maintenance of arrangement of the single layer is hard, and the phase of the filaments is disordered at wrapping or a subsequent handling, and the merits of the invention could not be displayed thereby. Therefore, the number of the filaments should be limited up to 5 pieces.

Figure 7:
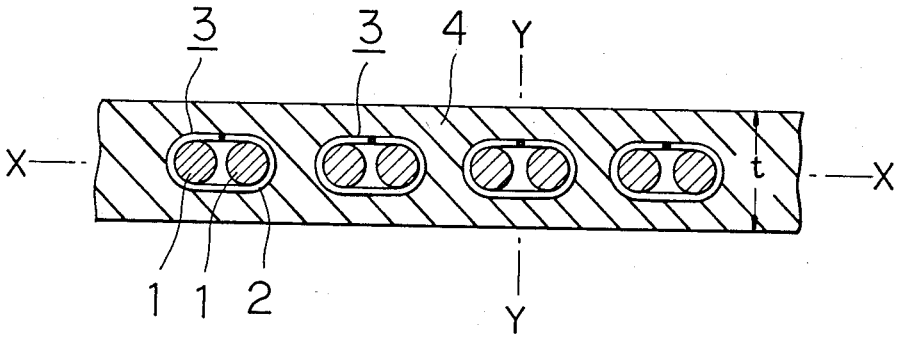
FIG. 7 is an enlarged view showing use of the steel core of the invention.
Figure 7:
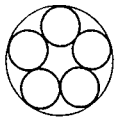
Figure 7:
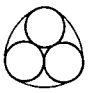
Figure 7:
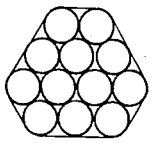

FIG. 7 exemplifies use of the steel cores of the invention. The steel cores 3, 3 of the flat and single layer are arranged in X-face and buried, with the determined spaces, in the rubber matrix, for example, a calender sheet 4, and if the calender sheets are laminated, a belt is made.

FUNCTION OF THE INVENTION

Since the vertical direction (Y-direction) places the filaments in one row, the calender sheet or the belt are enriched with flexibility. Since the multi-layer filaments are placed in the lateral direction (X-direction) rigidity is greater. If it is, therefore, applied to the tire, a hooping effect is desirous, so that the tire follows the profile of the road for required movement performance. Further, since the flexibility is preferable and although the bending stress is repeatedly applied to the belt, deterioration by fatigue is hardly present.

Actual investigations by the inventor are as follows.

The filaments were two pieces of steel wire of 0.30 mm in diameter having a brass plate, laid in parallel, and wrapped with a steel wire of 0.15 mm in diameter having a brass plate, so that the steel core of the flat and single layer as shown in FIG. 2 was provided.

Said steel cores were protected with rubber of 3 mm in thickness and the rigidity was measured. The measuring was performed by preparing a distance 100 mm between fulcrums, tensioning the belt sample at the center between the fulcrums, measuring tensile strength at the elastical amount of 2 mm, obtaining EI value from the formula of elastical amount (E: Young's modulus, and I: secondary moment in cross section), and changing the ratio of EI value into the ratio of the rigidity. As a result, in the X-direction rigidity was 133.3 Kg-mm$^2$ and in the Y-direction rigidity was 39.6 Kg-mm$^2$. The desired rigidity was provided in the X-direction and the excellent flexibility was provided in the Y-direction.

The steel core was observed undergoing bending fatigue by a 3 roller bending fatigue testing machine under conditions of the load being 2.4 Kg and the diameter of the roll being 25.4 mm. The rolling number until breakage was 2528. The steel core twisted 1×2 (0.30) was tested under the same conditions and resulted 2048. From this fact, it was seen that the invention largely improved the bending-fatique resistance.

Further, in the invention all the filaments of the steel cores are embedded in an X-face of a calender sheet, and so rigidity in the lateral directions of the belt is preferable. Thus, the invention may decrease the number of buried steel cores per unit length of the belt. In addition, since the core itselt is flat, the thickness t of the gauge of the calender sheet embedded therewith may be thinned. The tire can be flattened and lightened in weight.

The steel core 3 does not have twist nor torsion over the full length thereof but is linear, so that a displacing caused thereby is not created, resulting in preferred workability, and a cost-reduction may be realized together with said decreasing of the embedding number and gauge thickness.

The invention is featured in that 2 to 5 pieces of the filaments are laid in a parallel row and bound by the spiral wire, and excludes such an embodiment of multi-layers though the filaments are arranged in parallel.

The reason therefor is at first in penetration of the rubber. Where there is a steel core of a single structure as in the present invention, upper and lower faces directly contact the compound, perfecting the penetration. On the other hand, in the steel core of multi-layers, the adjacent filaments contact each other and make spaces encircled with the filaments. The penetration into the inner part of the compound could not be expected and corrosion of the core would be invited.

The second reason is in fatigue caused by fretting, i.e., abrading. In the invention, the structure is one layer, and the upper and lower faces are the rubber compound. Therefore, the fatigue resistance is not caused by the fretting. However, in the multi-layers, the rubber does not penetrate into the inner part and thereby cause fatique.

The third reason is present in the fatigue in the rubber. If the multi-layered steel core is applied to the tire belt, the steel core is subjected to bending stress by buckling of the tire. Then, the filament of the outermost layer is effected with the tensile stress, the filament of the middle layer is neutral, and the inner filament experiences compression stress. Therefore, the degree of the bending is large, and the inner filament exhibits deformation like the buckling phenomena. By repeating such a condition, the fatigue resistance is extremely deteriorated. In the invention, the outer part in cross section of the filament experiences tensile stress, and the inner part experiences compression stress. Although the tire was effected with the considerable buckling, the filament did not exhibit the buckling phenomena and the fatigue resistance did not decrease. Therefore, the fatigue resistance is largely improved.

EXAMPLE

The characteristic tests of the several steel cores of various diameters were performed. Results are shown in Tables 1 to 3. In each Table, samples Nos. 1 to 4 are of the invention, and No. 5 is the steel core of twisted type. The core structure Pn shows that n pieces of the filaments are laid in parallel. The fatigue resistance was measured by the 3 roller bending fatigue tests (load 10% × Breaking Strength (BS)) core in rubber. The air permeability was measured by the conditions of the air pressure being 0.52 Kg/cm$^2$ and the core burying length being 14 mm. The used wrapping wire was 0.15 mmϕ.

As apparent from Tables 1 to 3, it is seen that the steel cores of the invention have the excellent flexibilities and fatigue resistances in Y-directions.

TABLE 1

| No. | Structures of cores | Pitch cores | Pitch Wr | BS (N) | Ratio of rigidity (X/Y) | Fatigue resistance (Cycle) | Air permeability (ml/min) |
|---|---|---|---|---|---|---|---|
| 1 | P2(0.20) + 1 | — | 5.1 | 210 | 3.11 | 2530 | 0 |
| 2 | P3(0.20) + 1 | — | 5.2 | 305 | 5.56 | 3400 | 0 |
| 3 | P4(0.20) + 1 | — | 5.0 | 415 | 11.2 | 3620 | 0 |
| 4 | P5(0.20) + 1 | — | 5.2 | 505 | 17.5 | 4190 | 0 |
| 5 | 1 × 5 × 0.20 | 10.0 | — | 485 | 1.00 | 3750 | 1.2 |

TABLE 2

| No. | Structures of cores | Pitch cores | Pitch Wr | BS (N) | Ratio of rigidity (X/Y) | Fatigue resistance (Cycle) | Air permeability (ml/min) |
|---|---|---|---|---|---|---|---|
| 1 | P2(0.25) + 1 | — | 5.0 | 320 | 3.15 | 2530 | 0 |
| 2 | P3(0.25) + 1 | — | 5.1 | 485 | 5.96 | 3080 | 0 |
| 3 | P4(0.25) + 1 | — | 5.1 | 645 | 11.8 | 3500 | 0 |
| 4 | P5(0.25) + 1 | — | 5.2 | 805 | 18.2 | 4280 | 0 |
| 5 | 1 × 5 × 0.25 | 10.0 | — | 750 | 1.00 | 3730 | 2.1 |

TABLE 3

| No. | Structures of cores | Pitch cores | Pitch Wr | BS (N) | Ratio of rigidity (X/Y) | Fatigue resistance (Cycle) | Air permeability (ml/min) |
|---|---|---|---|---|---|---|---|
| 1 | P2(0.30) + 1 | — | 5.3 | 470 | 3.37 | 2528 | 0 |
| 2 | P3(0.30) + 1 | — | 5.2 | 690 | 5.20 | 3225 | 0 |
| 3 | P4(0.30) + 1 | — | 5.2 | 915 | 11.1 | 5015 | 0 |
| 4 | P5(0.30) + 1 | — | 5.2 | 1140 | 17.2 | 6276 | 0 |
| 5 | 1 × 5 × 0.30 | 14 | — | 1090 | 1.00 | 5120 | 0 |

I claim:

1. A reinforcing structure for elastomeric articles, comprising:

a plurality of elongated filaments arranged in parallel so as to have a common plane passing through all of said filaments; and means for wrapping said plurality of filaments together and including one wire having a diameter smaller than that of said filaments, said wire wrapping said filaments together so as to form a wrapped filament structure having a relative position of said filaments with respect to each other that does not vary over a full length of the wrapped filament structure and having bending rigidities in predetermined directions that also do not vary over a full length of the wrapped filament structure, the wrapped filament structure being formed so as to be embeddable into the elastomeric articles to be reinforced.

2. A reinforcing structure as defined in claim 1, wherein said plurality of filaments numbers between 2 and 5 inclusive.

3. A reinforcing structure as defined in claim 2, wherein said filaments each have a diameter between 0.20 and 0.30 mm inclusive.

4. A reinforcing structure as defined in claim 1, wherein said filaments each have a diameter between 0.20 and 0.30 mm inclusive.

5. A reinforcing structure as defined in claim 1, wherein said wire is spiraled around said filaments longitudinally.

6. A reinforced structure as defined in claim 1, wherein said filaments when wrapped have a rigidity higher in one transverse direction than in another transverse direction perpendicular to said one transverse direction when said filaments are wrapped.

7. A reinforcing structure as defined in claim 6, wherein said filaments have a rigidity ratio of said rigidity in said one transverse direction divided by said rigidity in said perpendicular transverse direction, said filaments being formed so that rigidity ratio is within about 3.0 to 18.5.

8. A reinforcing structure as defined in claim 1, wherein said filaments are arranged so as to form only a single layer when embedded in the elastomeric articles.

9. A reinforcing structure as defined in claim 1, wherein said filaments are arranged adjacent to each other in a linear and untwisted manner so as to have a bending-fatigue resistance greater than if said filaments had been arranged adjacent to each other in a twisted and non-linear manner.

10. A reinforcing structure as defined in claim 1, wherein each of said filaments is composed of a plated wire member having an adhesion to the elastomeric articles.

11. A reinforcing structure as defined in claim 10, wherein said plated member is formed as a brass plated steel wire.

12. A reinforcing structure as defined in claim 1, wherein said wire is formed as a metal plated steel wire.

* * * * *